US007578270B2

(12) United States Patent
Riley et al.

(10) Patent No.: US 7,578,270 B2
(45) Date of Patent: Aug. 25, 2009

(54) HEAT ACTIVATED VALVE SYSTEM

(75) Inventors: William Riley, Livonia, MI (US); Mark Zagata, Livonia, MI (US); Michael Schrader, Canton, MI (US); Greg McConville, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/787,054

(22) Filed: Apr. 13, 2007

(65) Prior Publication Data

US 2008/0251044 A1 Oct. 16, 2008

(51) Int. Cl.
*F01L 9/04* (2006.01)

(52) U.S. Cl. ..... 123/90.11; 123/90.16

(58) Field of Classification Search ..... 123/90.11, 123/90.12, 90.15, 90.16
See application file for complete search history.

(56) References Cited

U.S. PATENT DOCUMENTS

| | | | |
|---|---|---|---|
| 5,211,371 | A | 5/1993 | Coffee |
| 6,178,934 | B1 | 1/2001 | Hirasawa et al. |
| 6,625,848 | B1 | 9/2003 | Schneider |
| 6,830,019 | B2 | 12/2004 | Kluge |
| 6,843,465 | B1 | 1/2005 | Scott |
| 6,916,159 | B2 | 7/2005 | Rush et al. |
| 2005/0173661 | A1 | 8/2005 | Mignon et al. |

FOREIGN PATENT DOCUMENTS

| | | | |
|---|---|---|---|
| JP | 2001-173550 | | 6/2001 |
| JP | 2001173550 A | * | 6/2001 |

OTHER PUBLICATIONS

Abstract of JP 2001173550A shown above.*
"Nitinol Actuator Wire-Flexinot Nitinol Wire." Small Parts, Inc.-The Hardware Store for Researchers and Developers; Accessed Mar. 8, 2006. <http://www/smallparts.com/products/descriptions/naw.cfm>.

* cited by examiner

*Primary Examiner*—Zelalem Eshete
(74) *Attorney, Agent, or Firm*—Allan J. Lippa; Alleman Hall McCoy Russell & Tuttle LLP

(57) ABSTRACT

An electronically actuated valve assembly for an internal combustion engine is disclosed, wherein the valve assembly comprises a valve stem, a shape memory alloy actuator in operative communication with the valve stem, a coolant passage through which at least a portion of the shape memory alloy actuator extends, and a cooling fluid source in communication with the coolant passage.

13 Claims, 7 Drawing Sheets

HEAT ACTIVATED VALVE SYSTEM

BACKGROUND AND SUMMARY

Significant improvements in both fuel efficiency and performance of an internal combustion engine may be realized by the use of a camless valvetrain and electronic valve actuation. For example, the use of electronic valve actuation may allow control of such variables as valve lift and timing. In engines that utilize a mechanical drivetrain with a camshaft, these two parameters may be fixed at values selected as compromises for many different engine operating conditions. In contrast, the use of variable lift and timing may enable improved power, torque, and fuel economy by allowing these engine parameters to be optimized for current conditions.

Various difficulties have been encountered with the use of electronically actuated valves in an internal combustion engine. Accordingly, hydraulic and magnetic actuator solutions have been proposed. However, each of these solutions may impose high energy and package costs, potentially making implementation difficult. Furthermore, various parameters such as valve landing speed may be difficult to control in current electronically actuated valves. High landing speeds may lead to problems with valve wear and excessive noise.

The inventors herein have realized that the above-described problems may be addressed through the use of an electronically actuated valve assembly for an internal combustion engine, wherein the valve assembly comprises a valve stem, a shape memory alloy actuator in operative communication with the valve stem, a coolant passage through which at least a portion of the shape memory alloy actuator extends, and a cooling fluid source in communication with the coolant passage. Such an actuator may occupy less space than hydraulic or electromagnetic actuators, may utilize less power for actuation, and also may provide a greater degree of control over valve lift and landing.

DETAILED DESCRIPTION OF THE DEPICTED EMBODIMENTS

Figure 1:
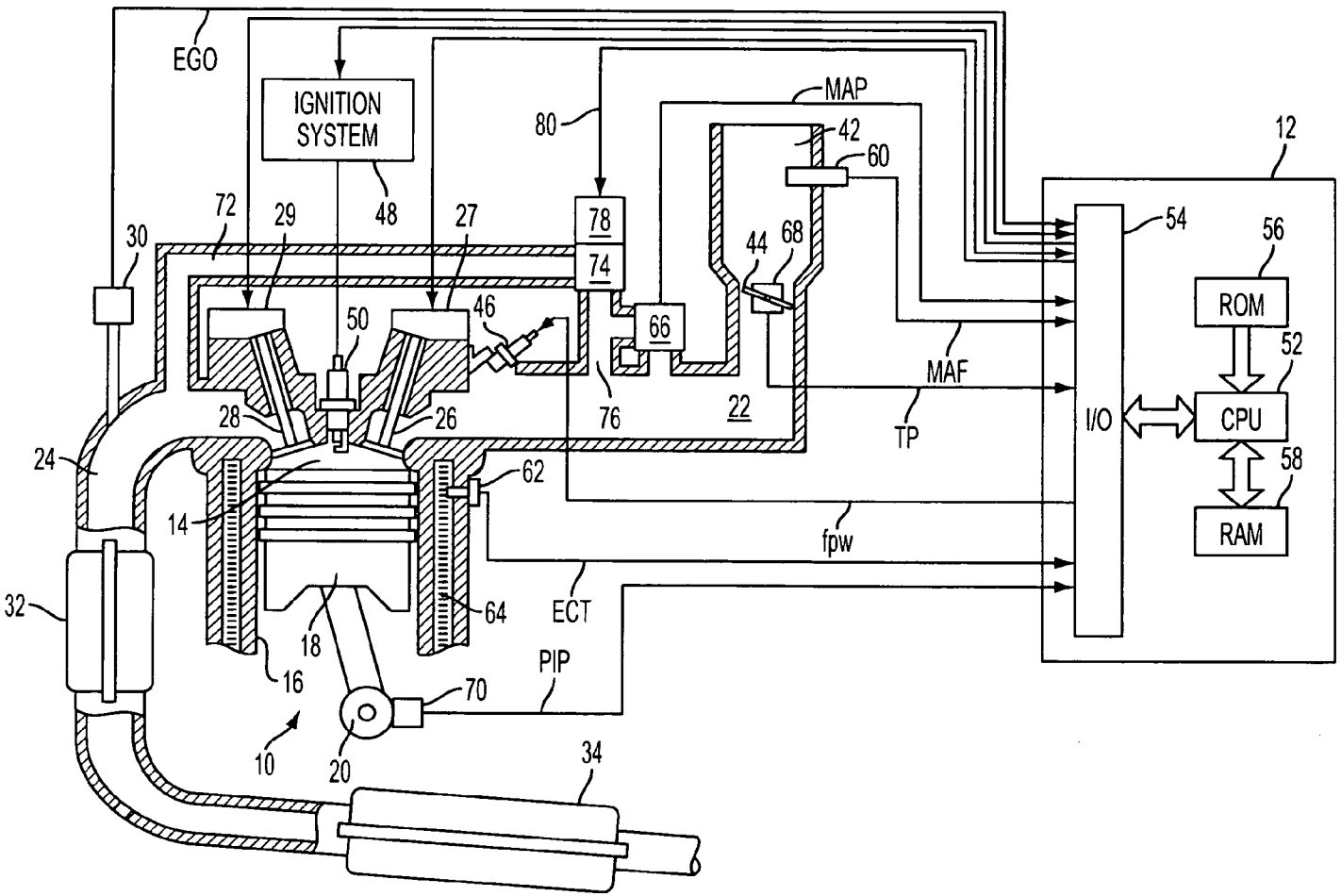
FIG. 1 shows a schematic depiction of an exemplary embodiment of an internal combustion engine.

FIG. 1 shows a schematic depiction of an exemplary embodiment of an internal combustion engine 10. Engine 10 is depicted as a port-injection spark-ignition gasoline engine. However, it will be appreciated that the systems and methods disclosed herein may be used with any other suitable engine, including direct-injection engines, and compression ignition engines including but not limited to diesel engines.

Engine 10 typically includes a plurality of cylinders, one of which is shown in FIG. 1, and is controlled by an electronic engine controller 12. Engine 10 includes a combustion chamber 14 and cylinder walls 16 with a piston 18 positioned therein and connected to a crankshaft 20. Combustion chamber 14 communicates with an intake manifold 22 and an exhaust manifold 24 via a respective intake valve 26 and exhaust valve 28. Intake valve 26 is operated by an intake valve actuation mechanism 27, and exhaust valve 28 is operated by an exhaust valve actuation mechanism 29, the operations of which are described in more detail below.

An exhaust gas oxygen sensor 30 is coupled to exhaust manifold 24 of engine 10. A catalyst 32, such as a three-way catalyst, is connected to and receives feedgas from exhaust manifold 24, and a NOx trap 34 is connected to and receives emissions from catalyst 32.

Intake manifold 22 communicates with a throttle body 42 via a throttle plate 44. Intake manifold 22 is also shown having a fuel injector 46 coupled thereto for delivering fuel in proportion to the pulse width of signal (fpw) from controller 12. Fuel is delivered to fuel injector 46 by a conventional fuel system (not shown) including a fuel tank, fuel pump, and fuel rail (not shown). Engine 10 further includes a conventional distributorless ignition system 48 to provide an ignition spark to combustion chamber 14 via a spark plug 50 in response to controller 12. In the embodiment described herein, controller 12 is a conventional microcomputer including: a microprocessor unit 52, input/output ports 54, an electronic memory chip 56, which may be electronically programmable memory, a random access memory 58, and a conventional data bus.

Controller 12 receives various signals from sensors coupled to engine 10, in addition to those signals previously discussed, including: measurements of inducted mass air flow (MAF) from a mass air flow sensor 60 coupled to throttle body 42; engine coolant temperature (ECT) from a temperature sensor 62 coupled to cooling jacket 64; a measurement of manifold pressure (MAP) from a manifold absolute pressure sensor 66 coupled to intake manifold 22; a measurement of throttle position (TP) from a throttle position sensor 68 coupled to throttle plate 44; and a profile ignition pickup signal (PIP) from a Hall effect sensor 70 coupled to crankshaft 20 indicating an engine speed (N).

Exhaust gas is delivered to intake manifold 22 by a conventional EGR tube 72 communicating with exhaust manifold 24, EGR valve assembly 74, and EGR orifice 76. Alternatively, tube 72 could be an internally routed passage in the engine that communicates between exhaust manifold 24 and intake manifold 22.

As described above, intake valve actuation system 27 and exhaust valve actuation system 29 may utilize an electronic valve actuation mechanism. The use of electronic valve actuation may allow intake valve 26 and exhaust valve 28 to be operated without a camshaft, and therefore may allow each intake valve and exhaust valve in the engine to be operated fully independently of other intake valves and exhaust valves. For example, one or more cylinders of an engine may be shut off for improved fuel economy when torque requirements are reduced, and may be turned back on when torque requirements increase.

One difficulty that has been encountered in implementing electronically actuated valves in a camless valvetrain system involves the actuation mechanism. Both hydraulic and electromechanical actuation systems have been proposed. However, hydraulic systems may cause a power demand on the engine, as these systems may require the engine oil pump to do additional work in providing hydraulic power. Likewise, solenoids used in electromechanical actuation systems may be relatively large and bulky, and therefore difficult to incorporate into an engine.

Figure 2B:
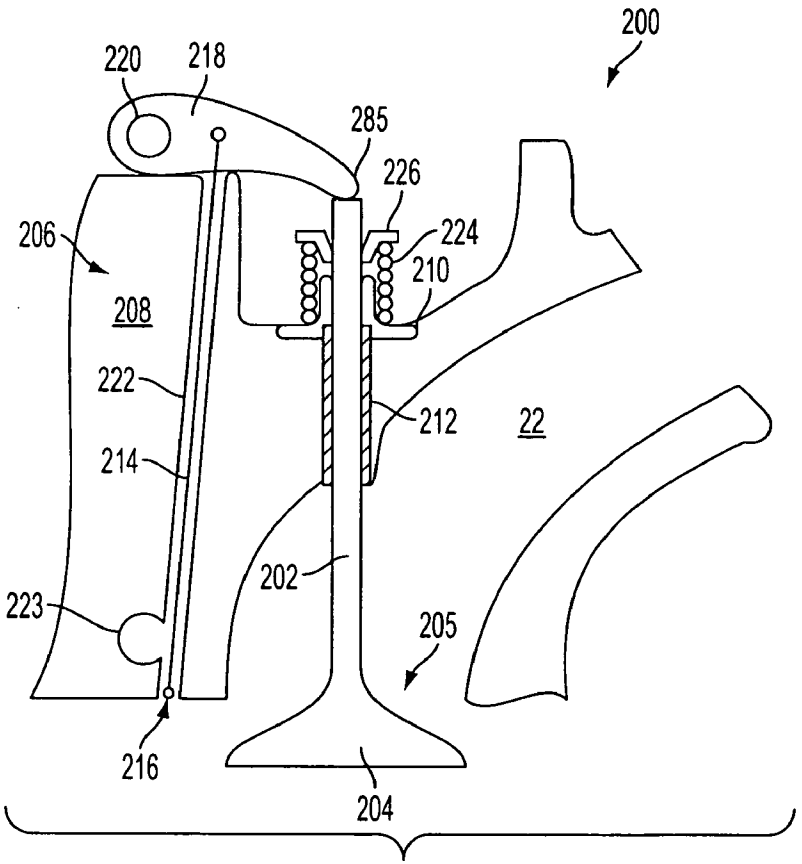
FIGS. 2A and 2B show a first embodiment of a shape memory alloy-actuated valve assembly in closed and opened positions, respectively.
Figure 2A:
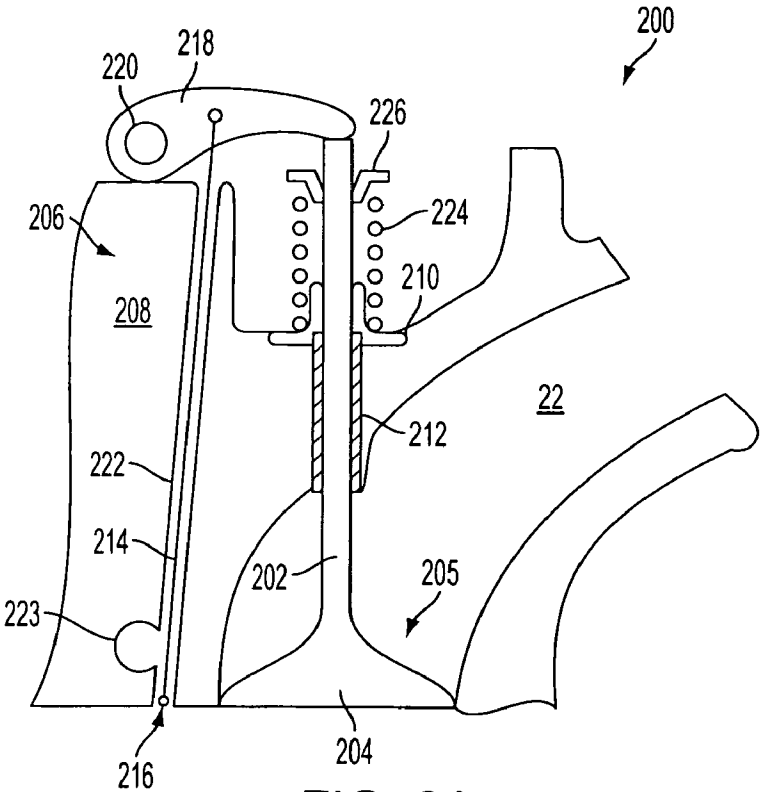

In contrast to hydraulic-based and solenoid-based actuation system, FIGS. 2A and 2B show an exemplary embodiment of a camless valve assembly 200 that utilizes a shape memory alloy actuator to open and close an engine valve. Shape memory alloys are materials that undergo a dimension-changing phase transition upon a temperature change and that return to the original geometry upon a reverse temperature/phase change. The length of the shape memory alloy wire may be changed by changing the temperature of the wire. The temperature change may be accomplished in any suitable manner, including but not limited to by directing an electrical current through the wire to heat the wire resistively. Depending upon the design of the actuator and the phase transition properties of the shape memory alloy material, a change in length of the shape memory alloy wire may cause a valve either to open or to close, as described in more detail below.

Referring to the embodiment shown in FIGS. 2A and 2B, FIG. 2A shows valve assembly 200 in a closed configuration, and FIG. 2B shows valve assembly 200 in an open configuration. Valve assembly 200 includes a valve stem 202, a valve disk 204 disposed in a valve opening 205, and a valve actuator 206. Valve stem 202 may extend through a portion of cylinder head 208 via stem seal 210 and valve guide 212.

Actuator 206 is configured to cause valve stem 202 to move linearly through valve guide 212, thereby moving valve disk 204 into or out of engagement with valve opening 205 and opening or closing valve assembly 200. To accomplish this motion, valve actuator 206 includes a shape memory alloy wire 214 extending from a fixed anchor 216 to a pivotally moveable rocker arm 218 or arm-like structure. Rocker arm 218 may be coupled at one location to a pivot 220 (e.g. roller shaft, ball pivot, etc.) around which it may rotate. Likewise, rocker arm 218 is coupled at another location to valve stem 202. Therefore, as shape memory alloy wire 214 contracts, rocker arm 218 pivots to move valve stem 202 and thereby open valve assembly 200. While the depicted shape memory alloy actuator takes the form of a single wire 214, it will be appreciated that the actuator may be formed from more than one wire, for example, arranged as a bundle, as described in more detail below. Furthermore, the shape memory alloy may take any other suitable geometric form than a wire.

Shape memory alloy wire 214 may be coupled to rocker arm 218 at any suitable location on rocker arm 218. For example, shape memory alloy wire 214 may be coupled to rocker arm 218 at or adjacent the location at which valve stem 202 is coupled to rocker arm 218, or at a location intermediate rocker arm 218 and pivot 220. Locating shape memory alloy wire 214 at a location between pivot 220 and valve stem 202 may provide a mechanical advantage that increases the length of travel of valve stem 202 relative to the dimension change of shape memory alloy wire 214.

Improved engine performance may be realized by quick and accurate valve actuator response times. Therefore, to facilitate the cooling of shape memory alloy wire 214 through the desired phase transition, shape memory alloy wire 214 may be exposed to a cooling fluid that speeds heat transfer from shape memory alloy wire 214. In this manner, shape memory alloy 214 may be cooled more rapidly than in the absence of a cooling fluid. This may help to improve actuator response times.

Any suitable cooling fluid may be used. For example, in some embodiments, engine oil may be used to cool shape memory alloy wire 214. In alternate embodiments, another engine fluid, such as antifreeze, may be used. In yet further embodiments, a dedicated fluid may be provided for the purpose of cooling shape memory alloy wire 214.

Likewise, any suitable mechanism may be used to apply the cooling fluid to shape memory alloy wire 214. For example, the cooling fluid may be sprayed or misted onto shape memory alloy wire 214. Alternatively, as depicted in FIGS. 2A and 2B, shape memory alloy wire 214 may extend at least partially through a coolant passage 222. In this configuration, the cooling fluid may be directed to flow through coolant passage 222 thereby removing heat from shape memory alloy wire 214. Coolant passage 222 may be coupled to an engine coolant circulation system where the cooling fluid is engine oil. An engine oil pump (not shown) may provide the coolant oil via an oil galley 223, or an engine oil circulation system 223. Alternatively, where the cooling fluid is a dedicated fluid, a separate pump (not shown) may be provided to circulate the cooling fluid through coolant passage 222.

In some embodiments, actuator 206 may further include a spring mechanism to bias valve stem 202 toward a closed configuration. Any suitable spring mechanism may be used. Examples include, but are not limited to, mechanical springs such as coil springs or leaf springs, and/or gas or pneumatic springs. In the embodiment depicted in FIGS. 2A and 2B, a coil spring 224 is positioned between stem seal 210 and a plate 226 coupled to valve stem 202. Spring 224 may be arranged in a state of compression such that it exerts a force against plate 226 to bias valve stem upwards. As such, valve actuation system 202 may selectively generate a force substantially in the downward displacement as required to counteract the force from the spring according to the signal output from controller 12. Therefore, referring specifically to FIG. 2A, when shape memory alloy wire 214 is in an elongated phase, spring 224 biases valve stem 202 into a closed position. Next, referring specifically to FIG. 2B, when shape memory alloy wire 214 is heated, the force of the alloy generated by the resulting phase transition pulls valve stem 202 into an opened position. Valve stem 202 may be returned to the closed position by cooling shape memory alloy wire 214 to a temperature below the phase transition temperature, thereby allowing spring 224 to push valve stem 202 into the closed position.

In embodiments in which spring 224 is a pneumatic spring, the force exerted by spring 224 against plate 226 may vary based on the air pressure in the spring. For example, air pressure in spring 224 may be increased to increase a force exerted against plate 226 to bias valve stem 202 more strongly toward a closed position. Likewise, when shape memory allow wire 214 is actuated, it may be advantageous to reduce the air pressure in the pneumatic spring so as to facilitate movement of valve stem 202 into opened position. Such control of the force exerted by spring 224 may offer improvements in fuel economy and engine performance.

Any suitable shape memory alloy material may be used to form shape memory alloy wire 214. Examples of suitable materials may include, but are not limited to, shape memory alloys with the following elemental combinations: Ag—Cd, Cu—Al—Ni, Cu—Sn, Cu—Zn, Cu—Zn—X (X=Si, Sn, Al), In—Ti, Ni—Al, Ni—Ti, Fe—Pt, Mn—Cu, Fe—Mn—Si, Ti—Ni—V, Ni—Ti—Cr, Ni—Ti—Fe, Ni—Ti—Cu, various Pt alloys, Co—Ni—Al, and Co—Ni—Ga.

It will be appreciated that the physical properties of the alloy and the structure of the valve assembly may be factors to be considered in the specific design of the actuator. For example, different alloys may have different electrical, mechanical and thermal properties, including but not limited to different phase transition temperatures, coefficients of expansion, electrical conductivities, etc. Likewise, the physical properties of various cooling fluids used with actuator 200 also may vary. These and other properties may affect the design of a specific embodiment of the valve actuator, including but not limited to the length, diameter, and other geometrical aspects of shape memory alloy wire 214, coolant passage 222, etc.

Another consideration in the design of shape memory alloy actuator 214 may be the desired actuator response time between controller 12 directing actuation and the actuator undergoing a phase change. For example, in some use environments, intake and exhaust valves 26, 28 may be operated at many thousands of rotations per minute. Furthermore, the timing of the opening and closing of these valves may be changed in response to various engine operating conditions. Therefore, it may be desirable for valve assembly 200 to have a fast response time to provide for accurate valve control at high engine speeds.

Figure 3:
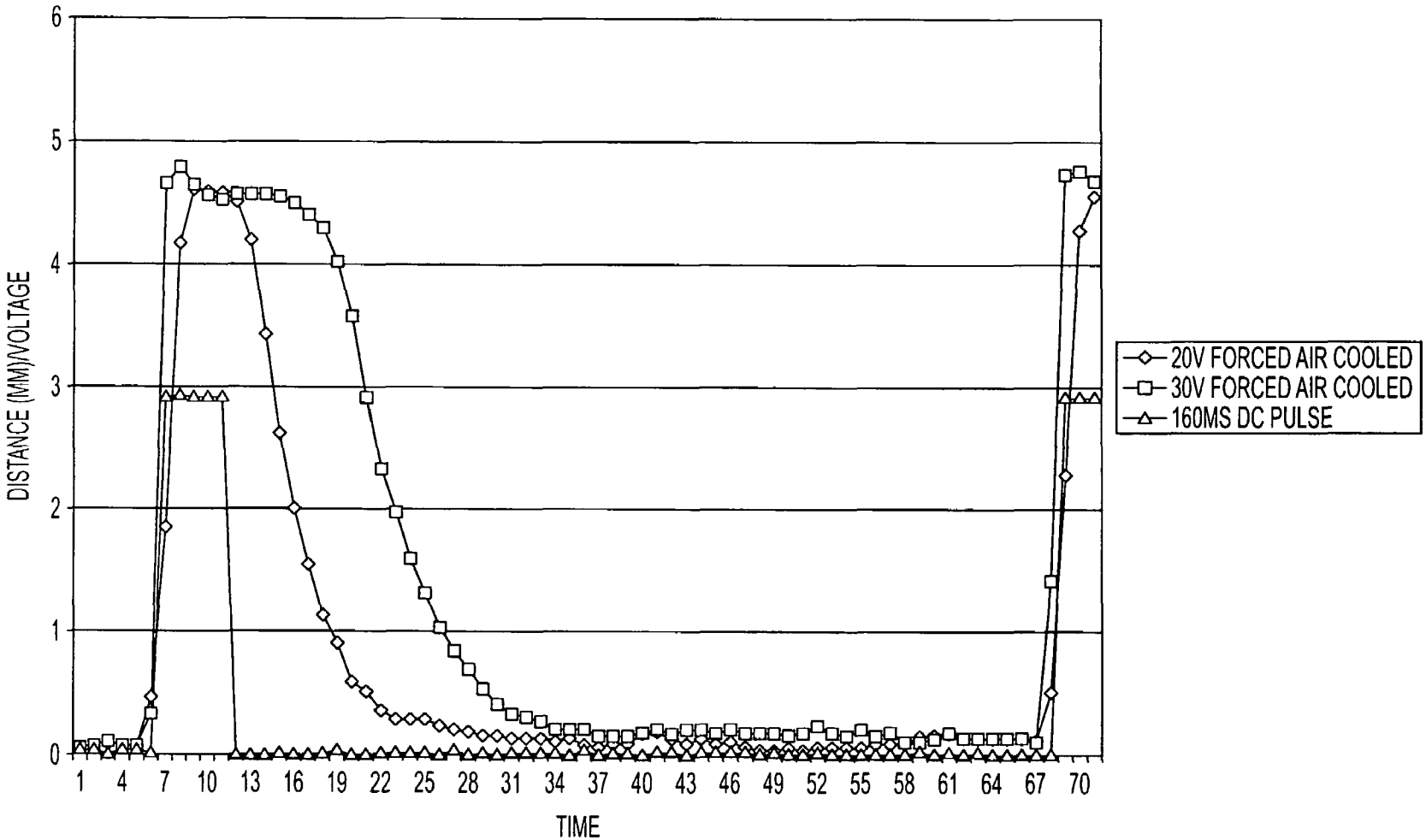
FIG. 3 shows a graphical representation of a change in length of a shape memory alloy wire as a function of time and applied voltage.

Various factors may affect the response time of valve assembly 200. For example, the current and/or voltage applied to shape memory alloy wire 214 may effect the response time. FIG. 3 shows a graphical representation of a response of an exemplary shape memory alloy wire as a function of time for different activation voltages. To produce this data, DC pulses of 140 milliseconds in duration were applied to a shape memory alloy at a voltage of 20 V and at a voltage of 30 V, and forced air cooling was used to cool the wire. From this figure, it can be seen that the 20 V pulse heated the shape memory alloy wire slightly more slowly than the 30 V pulse, but allowed the wire to cool substantially more quickly than the 30 V pulse.

In some embodiments, a pulse having multiple voltage levels may be used. For example, a higher voltage portion of the pulse may be used initially to cause the shape memory alloy to heat quickly, and then a lower voltage may be used to maintain the geometry of the shape memory alloy in the higher temperature phase. Removal of the lower voltage pulse may then allow the shape memory alloy wire to cool more quickly than if a voltage pulse of a single, higher voltage is used. In other embodiments, three or even more voltage levels may be used.

In yet other embodiments, a duty cycle of the signal applied to the shape memory alloy may be adjusted to control the temperature of the shape memory alloy. For example, pulse width modulation may be used to vary the duty cycle of the actuation signal, and therefore to control the temperature of shape memory alloy wire 214. For example, a duty cycle including a 1 ms pulse followed by 3 ms in an open circuit configuration may be applied to the shape memory alloy. This may result in the time-averaged power supplied to shape memory alloy 214 to be approximately 25% of the power of a steady-state signal of the same total duration. As a result, the shape memory alloy 214 may spend less total time in the heated phase, and exert less time-averaged force against spring 224. This may result in valve stem 202 being opened to a lesser degree than where a steady-state signal is applied, due to the lesser time-averaged force applied against spring 224. In this manner, the degree of contraction of the shape memory alloy, and therefore the length of travel of valve stem 202 and the lift of the valve disk, may be controlled. Control of the time-averaged force exerted against spring 224 may therefore allow the lift of valve stem 202 to be continuously varied in a controllable manner. It will be appreciated that any suitable configuration of electrical connections may connect shape memory alloy wire 214 to a power supply.

In various embodiments, variable valve lift may also be achieved via the use of a plurality of shape memory alloy wires, or by the actuation of only a portion of the length of a single shape memory wire actuator. First, FIGS. 4A-4D show an embodiment of a variable valve lift assembly 400 in various example valve lift configurations. The depicted valve assembly configurations include a closed configuration (shown at 402 in FIG. 4A), a first partially open configuration (shown at 404 in FIG. 4B), a second partially open configuration (shown at 406 in FIG. 4C), and a fully open configuration (shown at 408 in FIG. 4D). Valve assembly 400 includes a shape memory alloy actuator 410 and an electrical connector 412 for providing power to the actuator. It will be appreciated that the valve lift configurations illustrated herein are set forth for purposes of example, and are not intended to be limiting.

Actuator 410 also includes a first shape memory alloy wire 414, a second shape memory alloy wire 416, and a third shape memory alloy wire 418, wherein each wire is electrically connected to a separate switch. Likewise, electrical connector 412 includes a first switch 420, a second switch 422 and a third switch 424, wherein each switch is electrically connected to a single shape memory alloy wire 414, 416, or 418, (or a single bundle of shape memory alloy wires). It will be appreciated that switches 420, 422 and 424 (as well as the switches in other embodiments described below) may be physically separate from controller 12, or may be implemented via software, firmware or hardware on controller 12 executable by controller 12 to selectively apply or remove a voltage from across each shape memory alloy wire. In this sense, switches 420, 422 and 424 may also be considered to be multi-voltage electrical connections that are at least capable of supplying an on/off voltage to each shape memory alloy wire, and in some embodiments capable of supplying a multi-level or continuously variable voltage to each shape memory alloy wire.

In some embodiments, wires 414, 416 and 418 may be of varied length. As such, actuating different switches 420, 422 or 424 may cause a different wire to contract. Because the wires are of different lengths, the wires may contract by different lengths when actuated. In this manner, a desired lift may be achieved by actuating the wire 414, 416 or 418 that corresponds to the desired lift. For example, second shape memory alloy wire 416 may be longer than first shape memory alloy wire 414, and third shape memory alloy wire 418 may be longer than second wire 416 or first wire 414. Because a shape memory alloy wire typically contracts some percentage of the length of the wire when activated, a longer wire may contract by a longer distance than a shorter wire. As such, a current directed through second shape memory alloy wire 416 may contract a greater distance than first shape memory alloy 414 when activated. In this way, using various lengths of wires may allow various magnitudes of valve lift to be achieved.

Figure 4A:
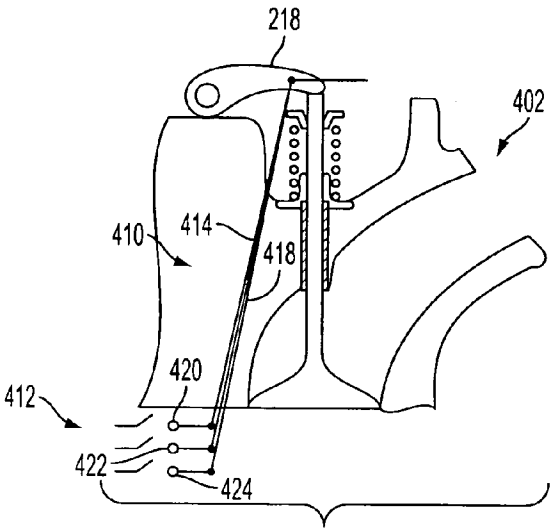
FIGS. 4A-4D show an embodiment of an alternative shape memory alloy actuator.

Referring now to FIG. 4A, valve assembly 400 is shown configured in a closed configuration 402. In this configuration, each of first shape memory alloy wire 414, second shape memory alloy wire 416, and third shape memory alloy wire 418 are in an elongated phase. The force exerted by spring 224 may therefore bias the valve assembly in closed configuration.

Figure 4B:
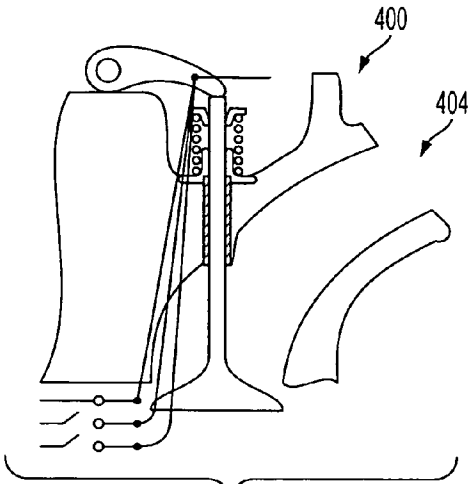

Referring now to FIG. 4B, valve assembly 400 is shown in a first open configuration. As seen in the Figure, first shape memory alloy wire 414 is electrically actuated by closure of switch 420, which causes wire 414 to heat and contract. As such, the force generated by the resulting phase transition may pull valve assembly 400 into a first opened position.

Second shape memory alloy wire 416 and third shape memory alloy wire 418 are shown as not being actuated, and therefore may remain in an elongated phase. While the depicted embodiment is actuated by heating, it will also be understood that various other embodiments may be actuated by cooling, and that switches 420, 422 and 424 may be opened or closed in any suitable manner to facilitate actuation in these embodiments.

Figure 4C:
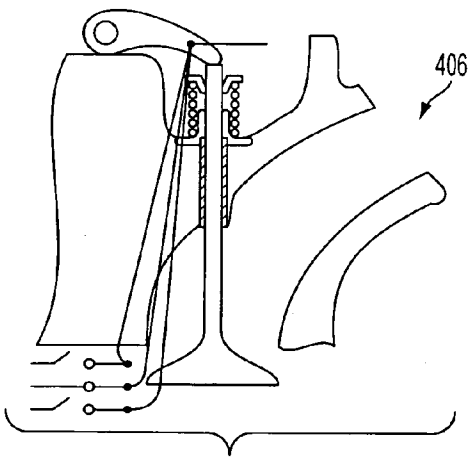

Referring now to FIG. 4C, valve assembly 400 is shown in a second open configuration actuated by second shape memory alloy wire 416 and second switch 422. In the second open configuration, valve assembly 400 has a greater lift than in the first open configuration due to the greater length of second shape memory alloy wire 416 compared to first wire 414.

Figure 4D:
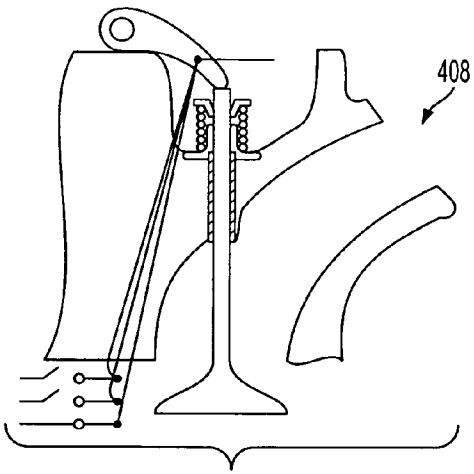

Referring now to FIG. 4D, valve assembly 400 is shown in a third open configuration actuated by third shape memory alloy wire 418 and third switch 424. In the third open configuration, valve assembly 400 has a greater lift than in the first and second open configurations due to the greater length of third shape memory alloy wire 418 compared to first wire 414 and second wire 416.

While the depicted shape memory alloy arrangement takes the form of three wires of different length, any suitable number of wires having any suitable lengths and differences in lengths may be used to achieve any suitable implementation of variable valve lift.

Figure 5A:
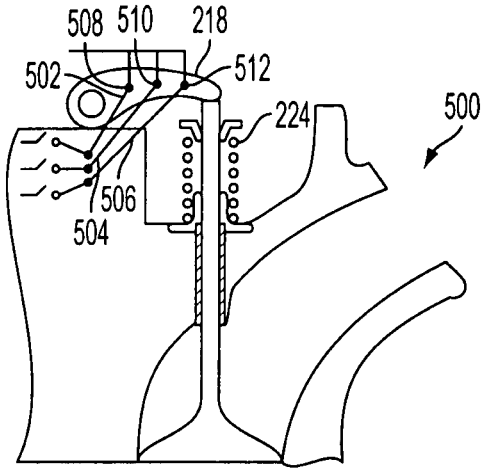
FIGS. 5A-5C show further alternative embodiments of shape memory alloy actuators.
Figure 5B:
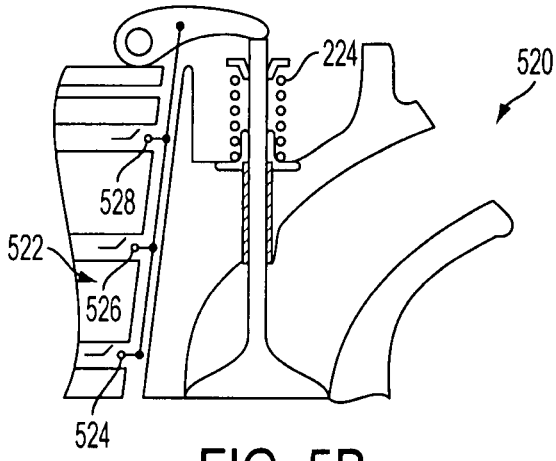
Figure 5C:
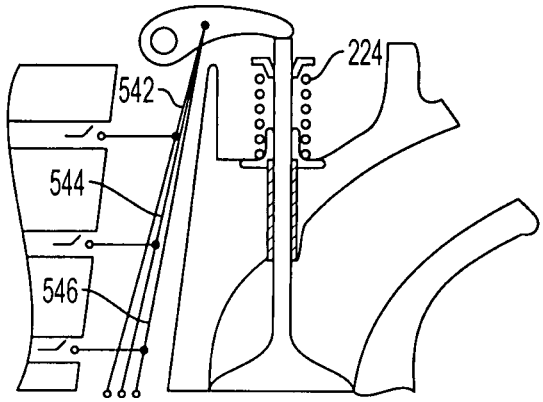

FIGS. 5A-5C schematically illustrates other alternate embodiments of wire arrangements that may enable variable valve lift. Referring first to FIG. 5A, valve assembly 500 includes various lengths of shape memory alloy wire attached to different locations on rocker arm 218. Specifically, a first wire 502 may be connected to rocker arm 218 at a first attachment point 508, a second wire 504 may be connected to rocker arm 218 at a second attachment point 510, and a third wire 506 may be connected to rocker arm 218 at a third attachment point 512. In this manner, the different attachment points may confer different mechanical advantages to each wire 502, 504 and 506. For example, because wire 502 is attached to rocker arm 218 at a point farther from the valve stem than wire 504 and wire 506, the actuation of wire 502 may provide a greater mechanical advantage than the actuation of wires 504 or 506, and therefore may cause a greater valve lift than actuation of wires 504 or 506. In some embodiments, the wires may have different lengths to provide a further range of variability in valve lift.

Referring next to FIG. 5B, valve assembly 520 includes a shape memory alloy wire 522 having an end electrical terminal 524, a first intermediate electrical terminal 526, and a second intermediate electrical terminal 528. The lift of valve assembly 520 may be controlled by controlling which electrical terminal is closed. For example, where only end electrical terminal 524 is closed, current flows through the entire length of shape memory alloy wire 522. Therefore, the whole length of wire 522 undergoes a phase change, causing maximum valve lift. On the other hand, where first intermediate electrical terminal 526 is closed, current flows through only the portion of wire 522 that extends between rocker arm 218 and first intermediate electrical terminal 526. In this manner, only a portion of wire 522 may undergo a phase change, thereby causing reduced valve lift. Likewise, closing second intermediate electrical terminal 528 may cause even a greater reduction in valve lift. Cooling fluid and/or current through the wire may be controlled to offer further control of the temperature along the length of wire 522.

Referring now to FIG. 5C, actuator 540 comprises multiple wires having a same or similar length. Three wires 542, 544 and 546 are depicted, but it will be appreciated that any suitable number of wires may be used. In the embodiment of FIG. 5C, variable valve lift may be achieved by activating different numbers of wires to thereby exert different pulling forces against spring 224. For example, to achieve a first, lowest lift, a single wire 542 may be activated. The force pulling against spring 224 is only that force exerted by wire 542. Therefore, the balance of forces between spring 224 and 542 may result in a first opened valve position, wherein the valve disk is located closer to the valve seat. Likewise, second and third lifts may be achieved by activating two wires (for example, 542 and 544), or all three wires, respectively. The force pulling against spring 224 will be greater for two activated wires than one activated wire, greater for three activated wires than two activated wires, etc. Therefore, the balance of forces between the shape memory alloy wires and spring 224 may result in progressively greater valve lifts with each additional activated wire.

The valve landing speed of valve assembly 200 may be controlled in a similar manner. For example, wire 216 may be cooled at a differential rate through the phase transition temperature, such that different portions of wire 216 may be cooled through the phase transition temperature at different times. This may be accomplished, for example, by applying a cooling fluid to only a portion of the length of wire 216. Likewise, a multi-segment wire may be utilized, in which current is removed from the segments in a controlled manner to control the rate at which the length of the multi-segment wire changes.

Figure 6B:
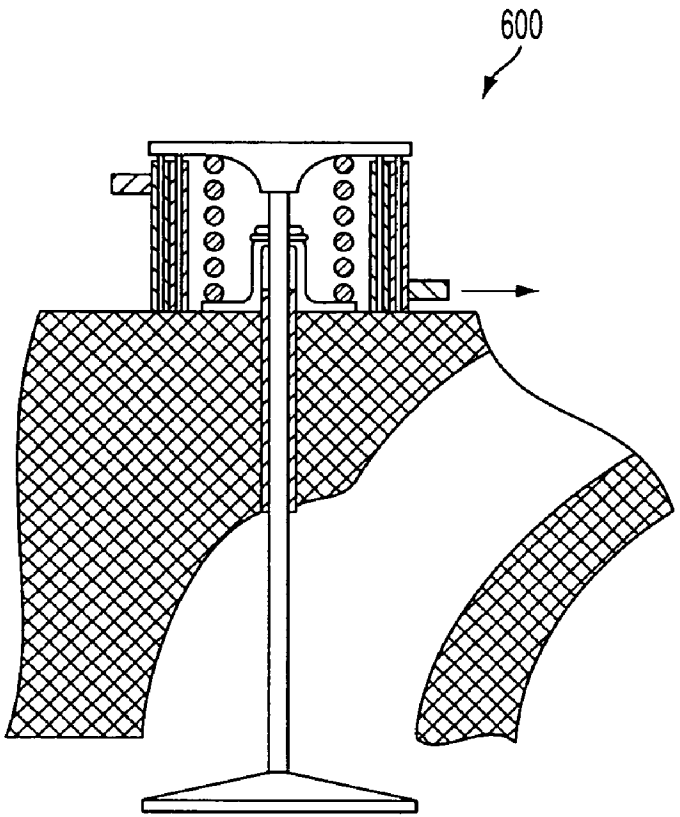
FIGS. 6A-6B show another embodiment of a shape memory alloy-actuated valve assembly in closed and opened positions, respectively.
Figure 6A:
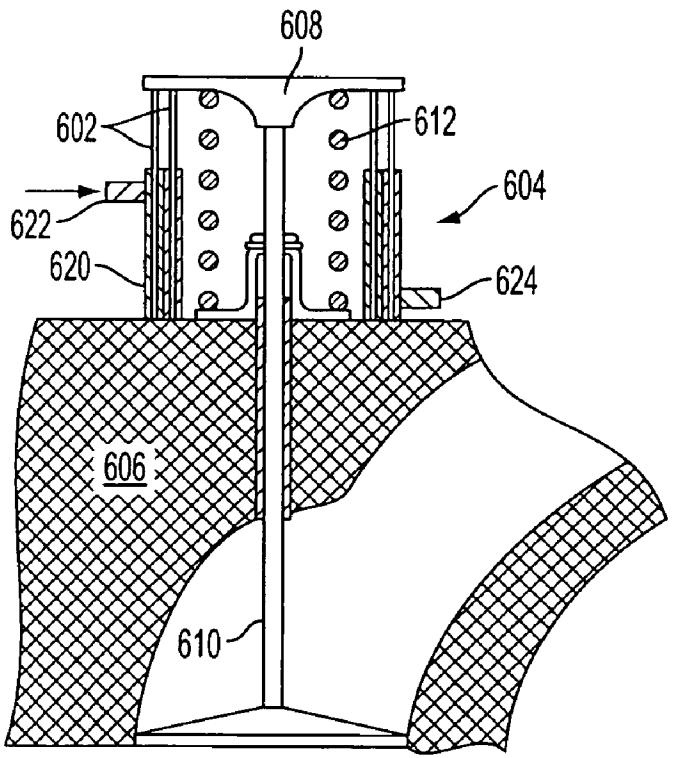

FIGS. 6A and 6B show another exemplary embodiment of a camless valve assembly 600. FIG. 6A shows the valve assembly in a closed configuration, FIG. 6B shows the valve in an open configuration. Whereas valve assembly 200 includes a pivotal rocker arm to which the valve stem and shape memory alloy wire are attached, valve assembly 600 does not utilize a rocker arm. Instead, valve assembly 600 comprises one or more shape memory alloy wires 602 extending between a stem seal 604 fixed to a cylinder head 606 and a spring plate 608 coupled to valve stem 610. Therefore, the travel distance of valve stem 610 is generally the same as the magnitude of the change in length of shape memory alloy wires 602. Further, a spring 612 may be employed to bias the valve stem toward a closed position. Such a configuration may allow valve assembly 600 to be relatively compact.

FIGS. 6A and 6B also illustrate the operation of valve assembly 600. Referring first to FIG. 6A, when shape memory alloy wires 602 are in a "longer" state, spring 612 holds valve assembly 600 closed. Next, as demonstrated by FIG. 6B, changing the temperature of shape memory alloy wires causes shape memory alloy wires 602 to decrease in length, thereby overcoming the force of spring 612 and moving valve assembly 600 into an opened position. Valve assembly 600 may be moved back into a closed position by effecting a reverse temperature change.

To help cool shape memory alloy wires 602, the wires may extend through a cooling channel 620 through which a coolant may be selectively pumped, as described above for valve assembly 200, via coolant inlet 622 and coolant outlet 624. The use of such a coolant, in combination with careful control of the application of an electrical current through shape memory alloy wires 602, may allow sufficient control of the temperature of shape memory alloy wires 602 to control such parameters as valve lift and valve landing speed.

The depicted valve assembly 600 includes a plurality of shape memory alloy wires arranged in parallel. However, it will be appreciated that any suitable number and arrangement of shape memory alloy wires may be used to actuate valve assembly 600. For example, in some embodiments, a single shape memory alloy wire may be used. In other embodiments, a bundle of shape memory alloy wires, or a plurality of bundles of shape memory alloy wires, may be used. Furthermore, while the depicted valve assembly 600 includes a mechanical coil spring 612, it will be appreciated that any other suitable spring may be used, including other mechanical springs such as leaf springs, and/or an air spring or other pneumatic spring.

Figure 7:
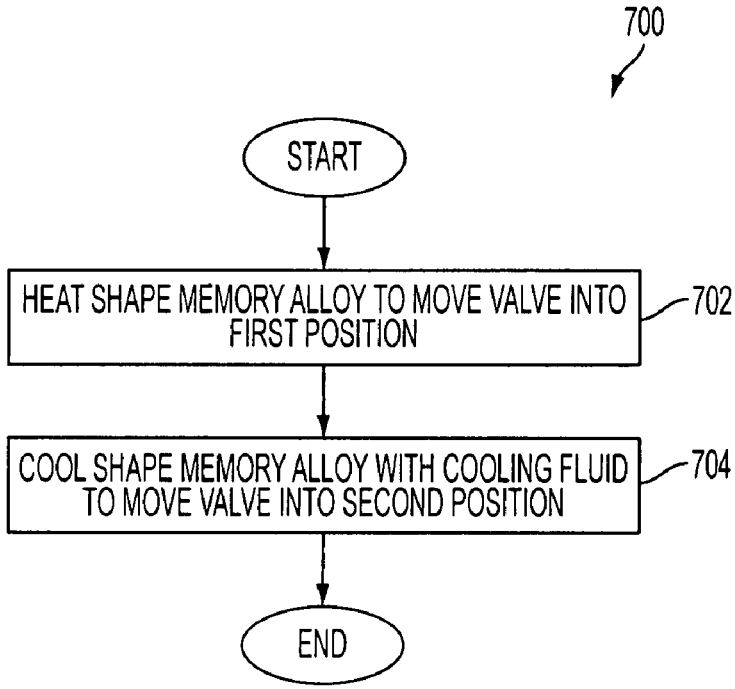
FIG. 7 shows an exemplary embodiment of a method of operating a shape memory alloy-actuated valve.

FIG. 7 shows an exemplary embodiment of a method 700 of operating a shape memory alloy-actuated valve. Method 700 includes, at 702, heating a shape memory alloy actuating member so as to move valve into a first position, and then at 704, cooling the shape memory alloy via a cooling fluid so as to move a valve into a second position. In some embodiments, the first position may be a closed position and the second position may be an open position, while in other embodiments the first and second positions may be open and closed positions, respectively.

Any suitable engine operating condition or change in engine operating condition may trigger actuation of a change in valve position. For example, engine operating conditions that may trigger valve to move towards a closed position (wherein valve lift is reduced, or even shut off) include, but are not limited to, detecting a decrease in engine torque. Likewise, engine operating conditions that may trigger valve to move towards an open position (wherein valve lift is increased, or even fully open) include, but are not limited to, detecting an increase in engine torque.

Referring specifically to step 702, the shape memory alloy may be heated in any suitable manner. For example, in some embodiments, the shape memory alloy may be heated by applying a voltage pulse across the alloy, thereby causing an electric current to flow through the alloy. The voltage pulse may have any suitable magnitude, and may have either a constant value, or a value that changes over time. For example, a higher initial voltage may be used to heat the alloy rapidly, and then a lower voltage may follow the higher initial voltage to maintain the alloy in the high-temperature phase for the desired duration and yet to permit more rapid cooling of the alloy upon cessation of the voltage pulse. Furthermore, the temperature of the shape memory alloy may also be increased by increasing a duty cycle of a signal applied across the alloy.

Likewise, referring now to step 704, the shape memory alloy may be cooled in any suitable manner. For example, lowering the voltage applied across the shape memory alloy. The voltage applied across the alloy may be reduced to zero or another suitable value. Alternatively, a duty cycle of the signal applied across the alloy may be changed, etc., to reduce the resistive heating of the shape memory alloy, in combination with the use of a cooling fluid. Further, any suitable cooling fluid may be used as a coolant. Examples include, but are not limited to, forced air, engine oil or other liquid coolants, etc.

Figure 8:
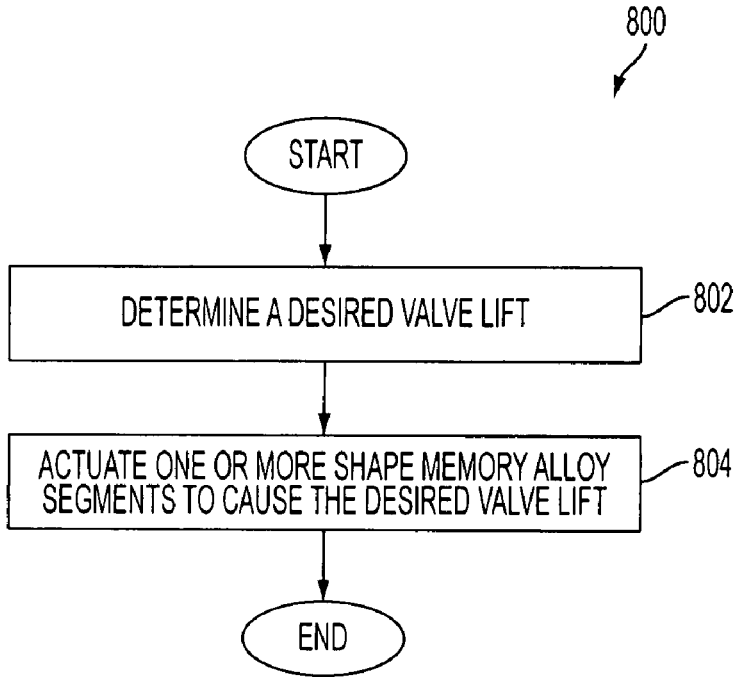
FIG. 8 shows an exemplary embodiment of another method of operating a shape memory alloy-actuated valve.

Next, FIG. 8 shows an exemplary embodiment of a method 800 of operating a shape memory alloy valve actuator that utilizes multiple shape memory alloy segments. In this embodiment, the individual shape memory alloy segments may be separate shape memory alloy wires, including but not limited to the configurations shown in FIGS. 4A-D, 5A, 5C, and 6A-B or may be separate segments of a single wire, such as that shown in FIG. 5B.

Method 800 first includes determining a desired valve lift at 802, and then actuating one or more shape memory alloy segments at 804 to cause a desired valve lift. The desired valve lift may be determined based upon various factors, including but not limited to current operating conditions such as desired torque, engine load, etc. Likewise, the number of shape memory alloy segments actuated at 804 may be selected in any suitable manner. For example, a number and/or identity of segments to actuate for various engine conditions may be predetermined and stored in a look-up table on controller 12. Likewise, a number and/or identity of segments to actuate for various engine conditions may be calculated dynamically based upon suitable mathematical models. It will be appreciated that valve landing may also be controlled where multiple shape memory alloy segments are actuated by controlling the order and timing of the deactuation of each shape memory segment. In this manner, a faster valve landing may be effected by deactuating the plurality of shape memory alloy segments simultaneously, while a slower valve landing may be effected by deactuating the shape memory alloy segments in a staggered or sequential fashion.

It will be appreciated that the various embodiments of valve assemblies disclosed herein are exemplary in nature, and these specific embodiments are not to be considered in a limiting sense, because numerous variations are possible. The subject matter of the present disclosure includes all novel and non-obvious combinations and subcombinations of the various shape memory alloy actuators, electrical configurations, valve configurations, and other features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the various features, functions, elements, and/or properties disclosed herein may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. An electronically actuated valve assembly for an internal combustion engine having a cylinder head, the valve assembly comprising:

a valve stem;

a shape memory alloy actuator in operative communication with the valve stem via an arm member at a first end of the shape memory alloy actuator;

a coolant passage in the cylinder head through which at least a portion of the shape memory alloy actuator extends, the coolant passage communicating with an oil galley at a second end of the shape memory alloy, the coolant passage further communicating with the arm member at the first end of the shape memory alloy actuator; and an oil pump in communication with the coolant passage at the second end of the shape memory alloy actuator via the oil galley.

2. The valve assembly of claim 1, wherein the coolant passage is coupled to an engine coolant circulation system.

3. The valve assembly of claim 1, wherein the arm member is a rocker arm to which the valve stem and the shape memory alloy actuator are coupled.

4. The valve assembly of claim 3, further comprising a pivot disposed on the arm member, wherein the shape memory alloy actuator is coupled with the arm member in a location intermediate the pivot and the valve stem.

5. The valve assembly of claim 3, wherein the shape memory alloy actuator comprises a shape memory alloy wire having a length greater than a length of the valve stem.

6. The valve assembly of claim 1, wherein the shape memory alloy actuator has a length equal to or less than the length of the valve stem.

7. The valve assembly of claim 1, wherein the shape memory alloy actuator comprises a plurality of shape memory alloy wires.

8. An electronically actuated valve assembly for an internal combustion engine having a cylinder head, the valve assembly comprising:

an arm member;

a pivot disposed at a first location on the arm member;

a valve stem coupled to the arm member at a second location on the arm member;

a shape memory alloy actuator having a first and second end, the first end operatively coupled with the arm member at a location between the valve stem and the pivot; and a coolant passage in the cylinder head through which a portion of the shape memory alloy actuator extends, the coolant passage communicating, at the second end of the shape memory alloy actuator, with an oil source, the coolant passage further communicating, at the first end, with the arm member.

9. The valve assembly of claim 8, wherein the shape memory alloy actuator comprises a shape memory alloy wire.

10. The valve assembly of claim 9, wherein the shape memory alloy actuator comprises a plurality of shape memory alloy wires.

11. The valve assembly of claim 8, wherein the shape memory alloy actuator comprises a shape memory alloy member with a length greater than a length of the valve stem.

12. The valve assembly of claim 8, wherein the coolant passage is coupled to an engine oil circulation system.

13. A method of operating an electronically actuated valve assembly for an internal combustion engine having a cylinder head, the valve assembly including a valve stem, a shape memory alloy actuator in operative communication with the valve stem via an arm member at a first end of the shape memory alloy actuator, a first terminal coupled to a first intermediate position of the shape memory alloy actuator, a second terminal coupled to a second position of the shape memory alloy actuator, the second position further away from the arm member than the first position; a coolant passage in the cylinder head through which at least a portion of the shape memory alloy actuator extends, including the first and second positions, the coolant passage communicating with an oil galley, the coolant passage further communicating with the arm member; and an oil pump in communication with the coolant passage via the oil galley, the method comprising:

actuating the valve with the first terminal to generate a first valve lift;

actuating the valve with the second terminal to generate a second valve lift greater than the first valve lift; and exposing the shape memory alloy to oil from the oil pump via the galley and the coolant passage, the oil being exposed to both the first and second terminals before reaching the arm member.

* * * * *